US009810033B1

(12) United States Patent
Shampine et al.

(10) Patent No.: US 9,810,033 B1
(45) Date of Patent: Nov. 7, 2017

(54) SUBSEA DRILLING SYSTEMS AND METHODS

(71) Applicant: SCHLUMBERGER TECHNOLOGY CORPORATION, Sugar Land, TX (US)

(72) Inventors: Rod William Shampine, Houston, TX (US); David Milton Eslinger, Collinsville, OK (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/256,251

(22) Filed: Sep. 2, 2016

(51) Int. Cl.

| | |
|---|---|
| ***E21B 4/02*** | (2006.01) |
| ***E21B 7/124*** | (2006.01) |
| ***E21B 17/20*** | (2006.01) |
| ***E21B 21/00*** | (2006.01) |
| ***E21B 19/22*** | (2006.01) |
| ***E21B 21/06*** | (2006.01) |
| ***E21B 21/08*** | (2006.01) |

(52) U.S. Cl.
CPC ..... *E21B 21/001* (2013.01); *E21B 4/02* (2013.01); *E21B 7/124* (2013.01); *E21B 17/20* (2013.01); *E21B 19/22* (2013.01); *E21B 21/065* (2013.01); *E21B 21/08* (2013.01)

(58) Field of Classification Search
CPC . E21B 4/02; E21B 7/124; E21B 17/20; E21B 19/22; E21B 21/001; E21B 21/065; E21B 21/08
See application file for complete search history.

(56) References Cited

U.S. PATENT DOCUMENTS

| | | | | |
|---|---|---|---|---|
| 3,234,736 | A | 2/1966 | Spalding | |
| 3,431,747 | A | 3/1969 | Hashemi et al. | |
| 6,325,159 | B1 * | 12/2001 | Peterman | E21B 21/001 166/350 |
| 6,540,487 | B2 * | 4/2003 | Polizos | F04B 1/2042 210/652 |
| 7,735,563 | B2 * | 6/2010 | Judge | E21B 43/121 166/344 |
| 8,322,435 | B2 * | 12/2012 | Judge | E21B 43/121 166/344 |
| 2004/0031622 | A1 * | 2/2004 | Butler | E21B 21/001 175/5 |

(Continued)

FOREIGN PATENT DOCUMENTS

NO WO 2007129899 A1 * 11/2007 ..... E21B 7/124

*Primary Examiner* — Matthew R Buck
(74) *Attorney, Agent, or Firm* — Rodney Warfford

(57) ABSTRACT

Apparatus and methods for performing subsea drilling operations. An example method may include receiving drilling fluid from a drilling fluid source at a first pressure by a pressure exchanger located within a subsea environment and receiving seawater from the subsea environment at a second pressure by the pressure exchanger to increase pressure of the drilling fluid within the pressure exchanger to a third pressure. The second and third pressures are substantially greater than the first pressure. The method may further include discharging the drilling fluid from the pressure exchanger into piping to communicate the drilling fluid to a drill forming a wellbore in a seabed and discharging the seawater from the pressure exchanger into the subsea environment.

20 Claims, 5 Drawing Sheets

(56) References Cited

U.S. PATENT DOCUMENTS

| | | | | |
|---|---|---|---|---|
| 2006/0204375 | A1* | 9/2006 | Judge | F04B 9/1235<br>417/393 |
| 2006/0245909 | A1* | 11/2006 | Stover | F04F 13/00<br>415/1 |
| 2009/0180903 | A1* | 7/2009 | Martin | F04F 13/00<br>417/405 |
| 2015/0275602 | A1* | 10/2015 | Kjosnes | E21B 33/085<br>175/25 |
| 2015/0292310 | A1* | 10/2015 | Ghasripoor | E21B 43/26<br>166/250.01 |
| 2016/0281487 | A1* | 9/2016 | Ghasripoor | E21B 43/20 |

* cited by examiner

SUBSEA DRILLING SYSTEMS AND METHODS

BACKGROUND OF THE DISCLOSURE

Wells are generally drilled into the ground or seabed to recover natural deposits of oil and gas, as well as other natural resources trapped in geological formations in the Earth's crust. Such wells are drilled using a drill bit attached to a lower end of a drill string or other drill piping. Drilling fluid ("mud") is pumped from the wellsite surface down through the drill piping to the drill bit. The drilling fluid lubricates and cools the bit, and may additionally carry drill cuttings from the wellbore back to the surface from which the wellbore extends.

The drilling fluid may be pumped through the drill piping by one or more high-pressure pumps. However, the drilling fluid may be a corrosive, abrasive, and/or solids-laden fluid, which can reduce functional life and increase maintenance of the high-pressure pumps.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a drilling system located on a seabed and operable to drill a wellbore through a rock formation below the seabed. The drilling system includes a drill operable to drill the wellbore, piping operable to convey the drill and communicate drilling fluid to the drill during drilling operations, a pump operable to pump seawater, and a pressure exchanger fluidly connected with the pump and the piping. The pressure exchanger is operable to receive the drilling fluid at a first pressure, and to receive the seawater from the pump at a second pressure to pressurize the drilling fluid to a third pressure. The second and third pressures are substantially greater than the first pressure. The pressure exchanger is also operable to discharge the drilling fluid into the piping, and to discharge the seawater into a subsea environment.

The present disclosure also introduces a method that includes receiving drilling fluid from a drilling fluid source at a first pressure by a pressure exchanger located within a subsea environment. The method also includes receiving seawater from the subsea environment at a second pressure by the pressure exchanger to increase pressure of the drilling fluid within the pressure exchanger to a third pressure. The second and third pressures are substantially greater than the first pressure. The method also includes discharging the drilling fluid from the pressure exchanger into piping to communicate the drilling fluid to a drill forming a wellbore in a seabed. The method also includes discharging the seawater from the pressure exchanger into the subsea environment.

The present disclosure also introduces a method that includes pumping drilling fluid from a wellbore at a first pressure into a pressure exchanger located within a subsea environment. Seawater from the subsea environment is pumped at a second pressure into the pressure exchanger to discharge the drilling fluid out of the pressure exchanger at a third pressure. The second and third pressures are substantially greater than the first pressure. The seawater is discharged out of the pressure exchanger into the subsea environment. The drilling fluid discharged from the pressure exchanger is communicated through piping to a drill connected with the piping. The drill is rotated to form the wellbore in a seabed.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
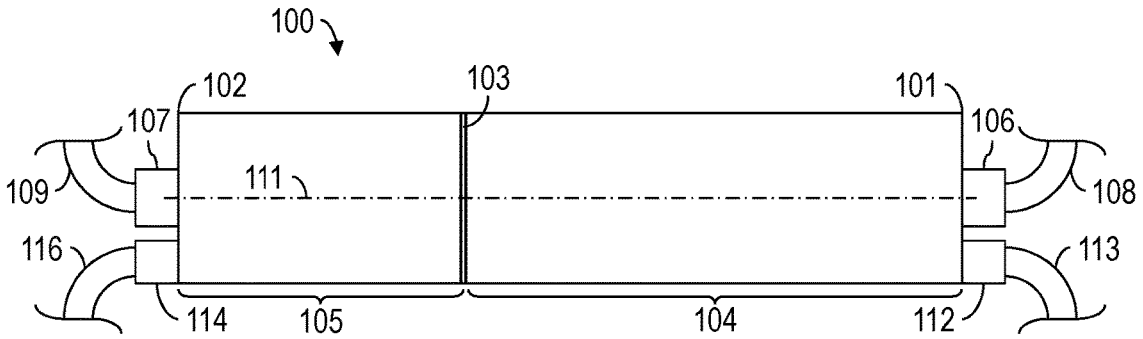
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. It should also be understood that the terms "first," "second," "third," etc., are arbitrarily assigned, are merely intended to differentiate between two or more parts, fluids, etc., and do not indicate a particular orientation or sequence.

The present disclosure introduces one or more aspects related to utilizing one or more pressure exchangers to divert corrosive, abrasive, and/or solids-laden (i.e., dirty) fluids away from high-pressure pumps, instead of pumping such fluids with the high-pressure pumps. A non-corrosive, non-abrasive, and solids-free (i.e., clean) fluid may be pressurized by the high-pressure pumps, while the pressure exchangers, located downstream from the high-pressure pumps, transfer the pressure from the pressurized clean fluid to a low-pressure dirty fluid. Such use of pressure exchangers may facilitate increased functional life of the high-pressure pumps and other wellsite equipment fluidly coupled between the high-pressure pumps and the pressure exchangers.

Example implementations of an apparatus described herein relate generally to a subsea or seabed drilling system utilizing a fluid system for pressurizing or pumping a drilling fluid for injection into a wellbore via drill piping during drilling operations. Accordingly, an example dirty fluid within the scope of the present disclosure may include a drilling fluid utilized during the drilling operations and an example clean fluid within the scope of the present disclosure may include seawater. The fluid system may include a drilling fluid storage container or another drilling fluid source, a high-pressure seawater pump, and a pressure exchanger fluidly connected with the drilling fluid source and the seawater pump. The fluid pressure exchanger may be operable to receive the drilling fluid from the drilling fluid source and pressurized seawater from the seawater pump to increase pressure or otherwise energize the drilling fluid, which may be injected into the wellbore via the drill piping during well drilling operations. The pressure exchanger may comprise one or more chambers operable to receive the drilling fluid and the seawater. The seawater may be pumped into the chamber at a higher pressure than the drilling fluid and may be utilized to pressurize the drilling fluid. The pressurized drilling fluid may then be discharged from the chamber into the drill piping to be conveyed into the wellbore being formed by the drill bit. By pumping just the seawater with the pumps and utilizing the pressure exchanger to pump or increase the pressure of the drilling fluid, useful life of the pumps may be increased. Example implementations of methods described herein relate generally to utilizing the drilling system and/or the fluid system to pump the drilling fluid into the wellbore via the drill piping during the well drilling operations.

As used herein, a drilling fluid may be or comprise a fluid that can flow and conform to the outline of its container. The drilling fluid may be a water based fluid, an oil based fluid, or a pneumatic fluid. The drilling fluid may have just one phase or more than one distinct phase. A drilling fluid may be a heterogeneous fluid having more than one distinct phase. An example heterogeneous drilling fluid within the scope of the present disclosure may include a solids-laden fluid or slurry (such as may comprise a continuous liquid phase and undissolved solid particles as a dispersed phase), an emulsion (such as may comprise a continuous liquid phase and at least one dispersed phase of immiscible liquid droplets), a foam (such as may comprise a continuous liquid phase and a dispersed gas phase), and mist (such as may comprise a continuous gas phase and a dispersed liquid droplet phase), among other examples also within the scope of the present disclosure. The drilling fluid may also be a homogenous fluid comprising clay, polymers, soluble salts, and other soluble additives mixed or dissolved within a base fluid. As used herein, seawater may include salt or fresh water located within a natural body of water within which the drilling system, including the fluid system, is constructed or otherwise located.

FIG. 1 is a schematic view of an example implementation of a chamber 100 of a fluid pressure exchanger for pressurizing a drilling fluid with seawater according to one or more aspects of the present disclosure. The chamber 100 includes a first end 101 and a second end 102. The chamber 100 may include a border or boundary 103 between the drilling fluid and seawater defining a first volume 104 and a second volume 105 within the chamber 100. The boundary 103 may be a membrane that is impermeable or semi-permeable to a fluid, such as a gas. The membrane may be an impermeable membrane in implementations in which the drilling fluid and seawater are incompatible fluids, or when mixing of the drilling fluid and seawater is to be substantially prevented, such as to recycle the seawater absent contamination by the drilling fluid. The boundary 103 may be a floating piston or separator slidably disposed along the chamber 100. The floating piston may physically isolate the drilling fluid and seawater and be movable via pressure differential between the drilling fluid and seawater. The floating piston may be retained within the chamber 100 by walls or other features of the chamber 100. The density of the floating piston may be set between that of the drilling fluid and seawater, such as may cause gravity to locate the floating piston at an interface of the drilling fluid and seawater when the chamber 100 is oriented vertically. The boundary 103 may also be a diffusion or mixing zone in which the drilling fluid and seawater mix or otherwise interact during pressurizing operations.

Figure 2:
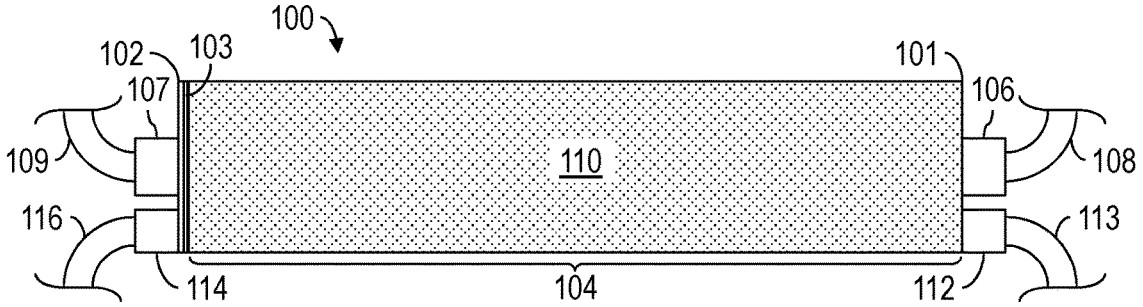
FIG. 2 is a schematic view of the apparatus shown in FIG. 1 in an operational stage according to one or more aspects of the present disclosure.

For example, FIG. 2 is a schematic view of the chamber 100 shown in FIG. 1 in an operational stage according to one or more aspects of the present disclosure, during which the drilling fluid 110 has been conducted into the chamber 100 through the first inlet valve 106 at the first end 101, such as via one or more fluid conduits 108. Consequently, the drilling fluid 110 may move the boundary 103 within the chamber 100 along a direction substantially parallel to the longitudinal axis 111 of the chamber 100, thereby increasing the first volume 104 and decreasing the second volume 105. The first inlet valve 106 may be closed after entry of the drilling fluid 110 into the chamber 100.

Figure 3:
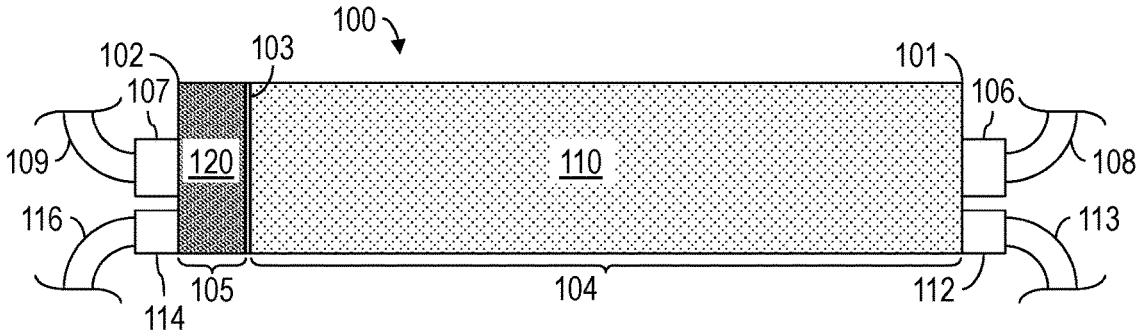
FIG. 3 is a schematic view of the apparatus shown in FIG. 2 in another operational stage according to one or more aspects of the present disclosure.

FIG. 3 is a schematic view of the chamber 100 shown in FIG. 2 in a subsequent operational stage according to one or more aspects of the present disclosure, during which seawater 120 is being conducted into the chamber 100 through the second inlet valve 107 at the second end 102, such as via one or more fluid conduits 109. The seawater 120 may be conducted into the chamber 100 at a higher pressure compared to the pressure of the drilling fluid 110. Consequently, the higher-pressure seawater 120 may move the boundary 103 and the drilling fluid 110 within the chamber 100 back towards the first end 101, thereby reducing the volume of the first volume 104 and thereby pressurizing or otherwise energizing the drilling fluid 110. The boundary 103 and/or other components may include one or more burst discs to protect against overpressure from the seawater 120.

Figure 4:
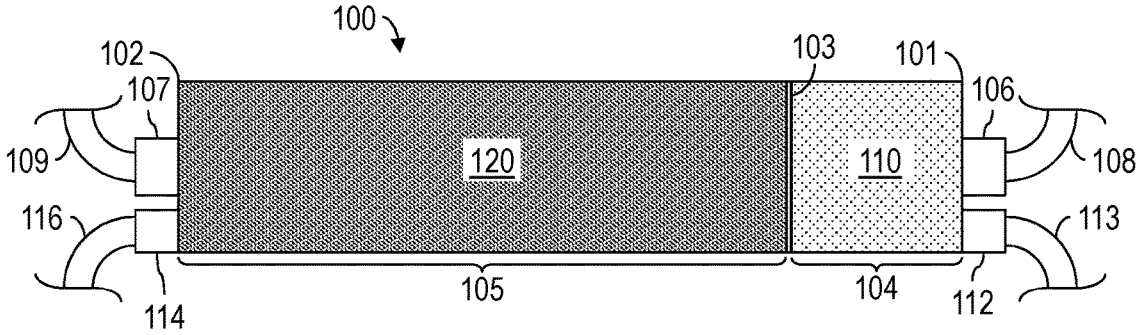
FIG. 4 is a schematic view of the apparatus shown in FIGS. 2 and 3 in another operational stage according to one or more aspects of the present disclosure.

As shown in FIG. 4, the boundary 103 may continue to reduce the first volume 104 as the pressurized drilling fluid 110 is conducted from the chamber 100 to drill piping 312 (shown in FIG. 10) at a higher pressure than when the drilling fluid 110 entered the chamber 100, such as via a first outlet valve 112 and one or more conduits 113. The second inlet valve 107 may then be closed, for example, in response to pressure sensed by a pressure transducer within the chamber 100 and/or along one or more of the conduits and/or inlet valves.

After the pressurized drilling fluid 110 is discharged from the chamber 100, the seawater 120 may be drained via an outlet valve 114 at the second end 102 of the chamber 100 and one or more conduits 116. The discharged seawater 120 may be discharged into the subsea environment, stored as waste fluid, or reused during subsequent iterations of the pressurizing process. For example, additional quantities of the drilling fluid and seawater 110, 120 may then be introduced into the chamber 100 to repeat the pressurizing process to achieve a substantially continuous supply of pressurized drilling fluid 110.

Figure 5:
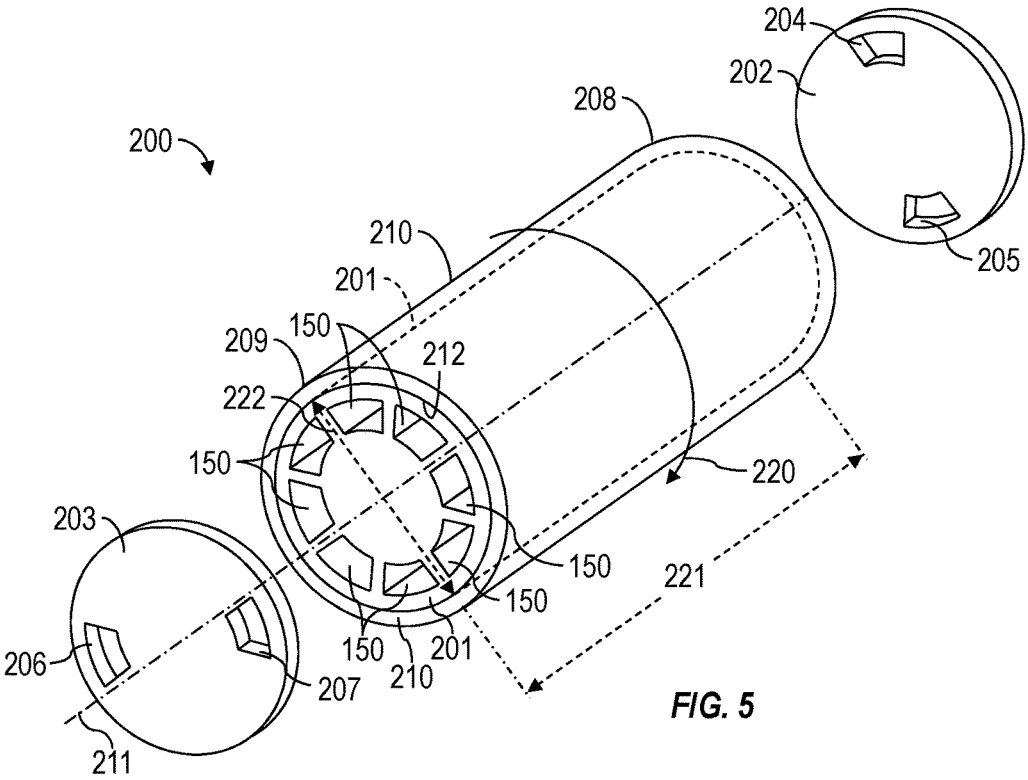
FIG. 5 is a partially exploded view of at least a portion of an example implementation of apparatus according to one or more aspects of the present disclosure.
Figure 6:
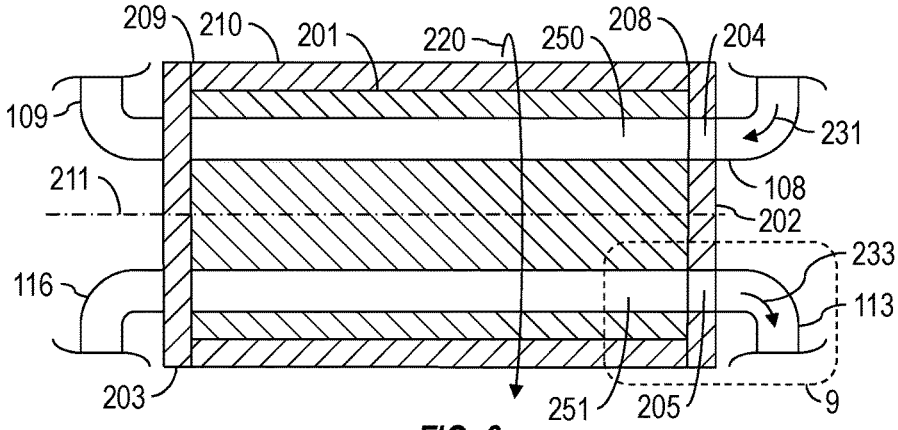
FIG. 6 is a sectional view of an example implementation of the apparatus shown in FIG. 5 according to one or more aspects of the present disclosure.
Figure 7:
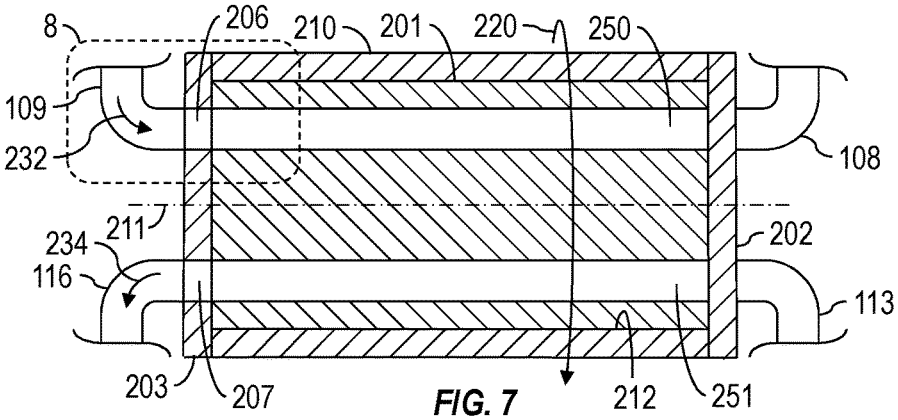
FIG. 7 is another view of the apparatus shown in FIG. 6 in a different stage of operation.

A fluid pressure exchanger comprising the apparatus shown in FIGS. 1-4 and/or others within the scope of the present disclosure may also comprise more than one of the example chambers 100 described above. FIG. 5 is a schematic view of an example fluid pressure exchanger 200 comprising multiple chambers 100 shown in FIGS. 1-4 and designated in FIG. 5 by reference numeral 150. FIGS. 6 and 7 are sectional views of the pressure exchanger 200 shown in FIG. 5. The following description refers to FIGS. 5-7, collectively.

The pressure exchanger 200 may comprise a housing 210 having a bore 212 extending between opposing ends 208, 209 of the housing 210. An end cap 202 may cover the bore 212 at the end 208 of the housing 210, and another end cap 203 may cover the bore 212 at the opposing end 209 of the housing 210. The housing 210 and the end caps 202, 203 may be sealingly engaged and statically disposed with respect to each other. The housing 210 and the end caps 202, 203 may be distinct components or members, or the housing 210 and one or both of the end caps 202, 203 may be formed as a single, integral, or continuous component or member. A rotor 201 may be slidably disposed within the bore 212 of the housing 210 and between the opposing end caps 202, 203 in a manner permitting relative rotation of the rotor 201 with respect to the housing 210 and end caps 202, 203. The rotor 201 may have a plurality of bores or chambers 150 extending through the rotor 201 and circumferentially spaced around an axis of rotation 211 extending longitudinally through the rotor 201. The rotor 201 may be a discrete member, as depicted in FIGS. 5-7, or an assembly of discrete components, such as may permit replacing worn portions of the rotor 201 and/or utilizing different materials for different portions of the rotor 201 to account for expected or actual wear.

Rotation of the rotor 201 about the axis 211 is depicted in FIG. 5 by arrow 220 and may be achieved by various means. For example, rotation may be induced by utilizing force of the fluids received by the pressure exchanger 200, such as in implementations in which the fluids may be directed into the chambers 150 at a diagonal angle with respect to the axis of rotation 211, thereby imparting a rotational force to the rotor 201 to rotate the rotor 201. Rotation may also be achieved by a longitudinal geometry or configuring of at least a portion of the chambers 150 extending through the rotor 201. For example, an inlet portion of the each chamber 150, or the entirety of each chamber 150, may extend in a helical manner with respect to the axis of rotation 211, such that the incoming stream of seawater imparts a rotational force to the rotor 201 to rotate the rotor 201.

Rotation may also be imparted via a motor 380 (shown in FIG. 11) operably connected to the rotor 201. For example, the motor 380 may be an electric or fluid powered motor connected with the rotor 201 via a shaft, a transmission, or another intermediate driving member 381, such as may extend through at least one of the end caps 202, 203 and/or the housing 210, to transfer torque to the rotor 201 to rotate the rotor 201. The motor 380 may also be connected with the rotor 201 via a magnetic shaft coupling (not shown), such as in implementations in which a driven magnet may be physically connected with the rotor 201 and a driving magnet may be located outside of the pressure exchanger 200 and magnetically connected with the driven magnet. Such implementations may permit the motor 380 to drive the rotor 201 without a shaft extending through the end caps 202, 203 and/or housing 210.

The end caps 202, 203 may functionally replace the valves 106, 107, 112, and 114 depicted in FIGS. 1-4. For example, the first end cap 202 may be substantially disc-shaped, or may comprise a substantially disc-shaped portion, through which an inlet 204 and an outlet 205 extend. The inlet 204 may act as the first inlet valve 106 shown in FIGS. 1-4, and the outlet 205 may act as the first outlet valve 112 shown in FIGS. 1-4. Similarly, the second end cap 203 may be substantially disc-shaped, or may comprise a substantially disc-shaped portion, through which an inlet 206 and an outlet 207 extend. The inlet 206 may act as the second inlet valve 107 shown in FIGS. 1-4, and the outlet 207 may act as the second outlet valve 114 shown in FIGS. 1-4. The fluid inlets and outlets 204-207 may have a variety of dimensions and shapes. For example, as in the example implementation depicted in FIG. 5, the inlets and outlets 204-207 may have dimensions and shapes substantially corresponding to the cross-sectional dimensions and shapes of the openings of each chamber 150 at the opposing ends of the rotor 201. However, other implementations are also within the scope of the present disclosure, provided that the chambers 150 may each be sealed against the end caps 202, 203 in a manner preventing or minimizing fluid leaks. For example the surfaces of the end caps 202, 203 that mate with the corresponding ends of the rotor 201 may comprise face seals and/or other sealing means.

In the example implementation depicted in FIG. 5, the rotor 201 comprises eight chambers 150. However, other implementations within the scope of the present disclosure may comprise as few as two chambers 150, or as many as several dozen. The rotational speed of the rotor 201 may also vary and may be timed as per the velocity of the boundary 103 between the drilling fluid and seawater and a length 221 of the chambers 150 so that the timing of the inlets and outlets 204-207 are adjusted in order to facilitate proper functioning as described herein. The rotational speed of the rotor 201 may be based on the intended flow rate of the pressurized drilling fluid exiting the chambers 150 collectively, the amount of pressure differential between the drilling fluid and seawater, and/or the dimensions of the chambers 150. For example, larger dimensions of the chambers 150 and greater rotational speed of the rotor 201 relative to the end caps 202, 203 and housing 210 will increase volumetric discharge rate of the pressurized drilling fluid.

FIG. 6 is a sectional view of the pressure exchanger 200 shown in FIG. 5 during an operational stage in which two of the chambers are substantially aligned with the inlet and outlet 204, 205 of the first end cap 202 but not with the inlet and outlet 206, 207 of the second end cap 203. Thus, the inlet 204 fluidly connects one of the depicted chambers 150, designated by reference number 250 in FIG. 6, with the one or more conduits 108 supplying the non-pressurized drilling fluid, such that the non-pressurized drilling fluid may be conducted into the chamber 250. At the same time, the outlet 205 fluidly connects another of the depicted chambers 150, designated by reference number 251 in FIG. 6, with the one or more conduits 113 conducting previously pressurized drilling fluid out of the chamber 251. As the rotor 201 rotates relative to the end caps 202, 203, the chambers 250, 251 will rotate out of alignment with the inlet and outlet 204, 205, thus preventing fluid communication between the chambers 250, 251 and the respective conduits 108, 113.

FIG. 7 is another view of the apparatus shown in FIG. 6 during another operational stage in which the chambers 250, 251 are substantially aligned with the inlet and outlet 206, 207 of the second end cap 203 but not with the inlet and outlet 204, 205 of the first end cap 202. Thus, the inlet 206 fluidly connects the chamber 250 with the one or more conduits 109 supplying the pressurizing or energizing seawater, such that the seawater may be conducted into the chamber 250. At the same time, the outlet 207 fluidly connects the other chamber 251 with the one or more conduits 116 conducting previously used pressurizing seawater out of the chamber 251, such as for return to the subsea environment. As the rotor 201 further rotates relative to the end caps 202, 203 and the housing 210, the chambers 250, 251 will rotate out of alignment with the inlet and outlet 206, 207, thus preventing fluid communication between the chambers 250, 251 and the respective conduits 109, 116.

The pressurizing process described above with respect to FIGS. 1-4 is achieved within each chamber 150, 250, 251 with each full rotation of the rotor 201 relative to the end caps 202, 203. For example, as the rotor 201 rotates relative to the end caps 202, 203 and the housing 210, the non-pressurized drilling fluid is conducted into the chamber 250 during the portion of the rotation in which the chamber 250 is in fluid communication with inlet 204 of the first end cap 202, as indicated in FIG. 6 by arrow 231. The rotation is continuous, such that the flow rate of non-pressurized drilling fluid into the chamber 250 increases as the chamber 250 comes into alignment with the inlet 204 and then decreases as the chamber 250 rotates out of alignment with the inlet 204. Further rotation of the rotor 201 relative to the end caps 202, 203 permits the pressurizing seawater to be conducted into the chamber 250 during the portion of the rotation in which the chamber 250 is in fluid communication with the inlet 206 of the second end cap 203, as indicated in FIG. 7 by arrow 232. The influx of the pressurizing seawater into the chamber 250 pressurizes the drilling fluid, such as due to the pressure differential between the drilling fluid and seawater described above with respect to FIGS. 1-4.

Further rotation of the rotor 201 relative to the end caps 202, 203 and the housing 210 permits the pressurized drilling fluid to be conducted out of the chamber 250 during the portion of the rotation in which the chamber 250 is in fluid communication with the outlet 205 of the first end cap 202, as indicated in FIG. 6 by arrow 233. The discharged fluid may substantially comprise just the (pressurized) drilling fluid or a mixture of the drilling fluid and seawater (also pressurized), depending on the timing of the rotor 201 and perhaps whether the chambers include the boundary 103 shown in FIGS. 1-4. Further rotation of the rotor 201 relative to the end caps 202, 203 permits the reduced-pressure seawater to be conducted out of the chamber 250 during the portion of the rotation in which the chamber 250 is in fluid communication with the outlet 207 of the second end cap 203, as indicated in FIG. 7 by arrow 234. The pressurizing process then repeats as the rotor 201 further rotates and the chamber 250 again comes into alignment with the inlet 204 of the first end cap 202.

Depending on the number and size of the chambers 150, the non-pressurized drilling fluid inlet 204 and the pressurizing seawater inlet 206 may be wholly or partially misaligned with each other about the central axis 211, such that the drilling fluid may be conducted into the chamber 150 to entirely or mostly fill the chamber 150 before the seawater is conducted into that chamber 150. The non-pressurized drilling fluid inlet 204 is completely closed to fluid flow from the conduit 108 before the pressurizing seawater inlet 206 begins opening. The pressurized drilling fluid outlet 205 and the reduced-pressure seawater outlet 207, however, may be partially open when the pressurizing seawater inlet 206 is permitting the seawater into the chamber 150. Similarly, the non-pressurized drilling fluid inlet 204 may be partially open when one or both of the pressurized drilling fluid outlet 205 and/or the reduced-pressure seawater outlet 207 is at least partially open.

The pressurized drilling fluid outlet 205 and the reduced-pressure seawater outlet 207 may be wholly or partially misaligned with each other about the central axis 211. For example, the pressurized drilling fluid (and perhaps a pressurized mixture of the drilling fluid and seawater) may be substantially discharged from a chamber 150 via the pressurized drilling fluid outlet 205 before the remaining reduced-pressure seawater is permitted to exit through the reduced-pressure seawater outlet 207. As the rotor 201 continues to rotate relative to the end caps 202, 203 and the housing 210, the pressurized drilling fluid outlet 205 becomes closed to fluid flow, and the reduced-pressure seawater outlet 207 becomes open to discharge the remaining reduced-pressure seawater. Thus, the reduced-pressure seawater outlet 207 may be completely closed to fluid flow while the pressurized drilling fluid (or mixture of the drilling fluid and seawater) is discharged from the chamber 150. Complete closure of the reduced-pressure seawater outlet 207 may permit the pressurized fluid to maintain a higher-pressure flow to the drill piping.

The inlets and outlets 204-207 may also be configured to permit fluid flow into and out of more than one chamber 150 at a time. For example, the non-pressurized drilling fluid inlet 204 may be sized to simultaneously fill more than one chamber 150, the inlet and outlets 204-207 may be configured to permit non-pressurized drilling fluid to be conducted into a chamber 150 while the reduced-pressure seawater is simultaneously being discharged from that chamber 150. Depending on the size of the rotor 201 and the chambers 150, the fluid properties of the drilling fluid and seawater, and the rotational speed of the rotor 201 relative to the end caps 202, 203, the pressurizing process within each chamber 150 may also be achieved in less than one rotation of the rotor 201 relative to the end caps 202, 203 and the housing 210, such as in implementations in which two, three, or more iterations of the pressurizing process is achieved within each chamber 150 during a single rotation of the rotor 201.

The flow of drilling fluid out of the pressure exchanger 200 via the fluid conduit 116 may be prevented or otherwise minimized by controlling the timing of the opening and closing of the fluid inlets 204, 206 and outlets 205, 207 of the pressure exchanger 200. For example, during the pressurizing operations, as the chambers 150 rotate, each chamber 150 is in turn aligned and, thus, fluidly connected with the low-pressure inlet 204 to receive the drilling fluid and the low-pressure outlet 207 to discharge the seawater. As the drilling fluid fills the chamber 150, the boundary 103 moves toward the low-pressure outlet 207 as the seawater is pushed out of the chamber 150. However, the rotation of the rotor 201 seals off the outlet 207 of the chamber 150 when or just before the boundary 103 reaches the outlet 207 to prevent or minimize the drilling fluid from entering into the fluid conduit 116. The chamber 150 then becomes aligned with the high-pressure inlet 206 and the high-pressure outlet 205 to permit the high-pressure seawater to enter the chamber 150 via the inlet 206 to push or force the drilling fluid out of the chamber 150 via the outlet 205 at an increased pressure. As the seawater fills the chamber 150, the boundary 103 moves toward the high-pressure outlet 205 as the drilling fluid is pushed out of the chamber 150. However, the rotation of the rotor 201 seals off the outlet 205 of the chamber 150 when or just before the boundary 103 reaches the outlet 205 to prevent or minimize the seawater from entering into the fluid conduit 113. The seawater left in the chamber 150 may be pushed out through the fluid conduit 116 by the drilling fluid when the chamber 150 again becomes aligned with the low-pressure inlet 204 to receive the drilling fluid and the low-pressure outlet 207 to discharge the seawater. Such cycle may be continuously repeated to continuously receive and pressurize the stream of drilling fluid.

Figure 8:
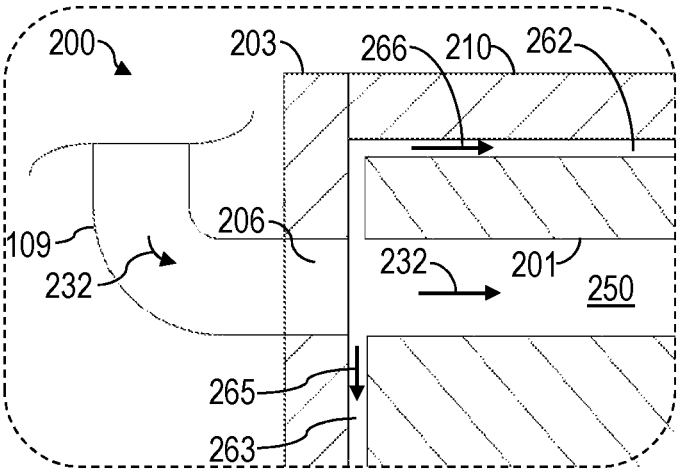
FIG. 8 is an enlarged view of the apparatus shown in FIG. 7 according to one or more aspects of the present disclosure.
Figure 9:
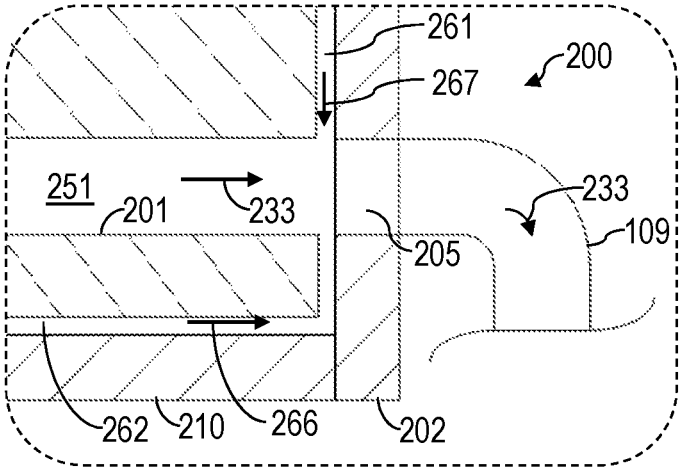
FIG. 9 is an enlarged view of the apparatus shown in FIG. 6 according to one or more aspects of the present disclosure.

FIGS. 8 and 9 are enlarged views of portions of the pressure exchanger 200 shown in FIGS. 7 and 6, respectively, according to one or more aspects of the present disclosure. The following description refers to FIGS. 6-9, collectively.

Small gaps or spaces 261, 262, 263 may be maintained between the rotor 201 and the housing 210 and end caps 202, 203 to permit rotation of the rotor 201 within the housing 210 and the end caps 202, 203. For clarity, the housing 210 and the end caps 202, 203 may be collectively referred to hereinafter as a "housing assembly." The spaces 261, 262, 263 may permit fluid flow between the rotor 201 and the housing assembly. For example, drilling fluid within the pressure exchanger 200 may flow through the space 261 along the end cap 202 from the high-pressure outlet 205 to the low-pressure fluid inlet 204, and through the spaces 261, 262, 263 along the housing 210 and end caps 202, 203 from the high-pressure outlet 205 to the low-pressure seawater outlet 207. The seawater within the pressure exchanger 200 may flow through the space 263 along the end cap 203 from the high-pressure inlet 206 to the low-pressure outlet 207, as indicated by arrow 265, and through the spaces 261, 262, 263 along the housing 210 and end caps 202, 203 from the high-pressure inlet 206 to the drilling fluid inlet and outlet 204, 205, as indicated by arrows 265, 266, 267.

The fluid flow through the spaces 261, 262, 263 within the pressure exchanger 200 may form a fluid film or layer operating as a hydraulic bearing or otherwise providing lubrication between the rotating rotor 201 and the static housing assembly, such as may prevent or reduce contact or friction between the rotor 201 and the housing assembly during pressurizing operations. The flow of fluids through the spaces 261, 262, 263 may be biased such that substantially just the seawater, and not the drilling fluid, flows through the spaces 261, 262, 263 during pressurizing operations, as indicated by arrows 265, 266, 267. Biasing the flow of seawater through the spaces 261, 262, 263 may also cause the boundary 103 (shown in FIGS. 1-4) to maintain a net velocity directed toward the drilling fluid outlet 205. Accordingly, biasing the flow of the seawater may result in substantially just the seawater being communicated through the spaces 261, 262, 263, such as to prevent or minimize friction or wear caused by the drilling fluid between the rotor 201 and the housing assembly. Biasing the flow of the seawater may also result in substantially just the seawater being discharged via the seawater outlet 207, such as to prevent or minimize contamination of the seawater discharged from the pressure exchanger 200.

Figure 10:
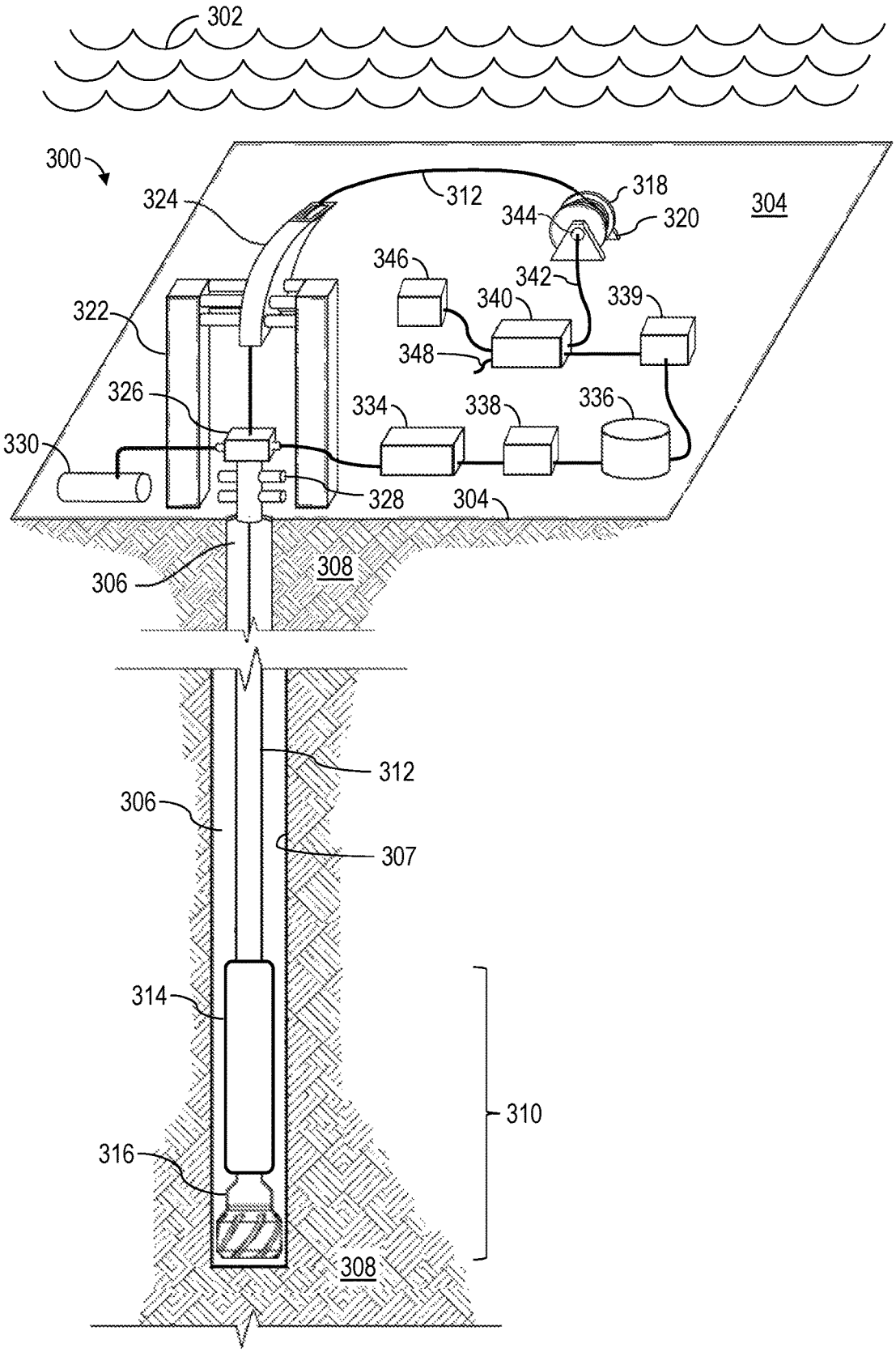
FIG. 10 is a schematic view of at least a portion of an example implementation of apparatus according to one or more aspects of the present disclosure.

FIG. 10 is a schematic view of at least a portion of an example subsea drilling system 300 according to one or more aspects of the present disclosure, representing an example environment in which one or more apparatus described herein may be implemented, including to perform one or more methods and/or processes also described herein. The drilling system 300 may be located within a subsea environment (i.e., seawater) below seawater surface 302 and constructed or assembled on a seabed 304 proximate a wellbore 306 extending from the seabed 304 into one or more subterranean rock formations 308. FIG. 1 also depicts a sectional view of the formation 308 containing the wellbore 306, as well as a bottom hole assembly (BHA) 310 positioned within the wellbore 306. The BHA 310 may be conveyed from the seabed 304 via drill piping 312 extending from the seabed 304. The piping 312 may terminate with the BHA 310, which may comprise a mud or drill motor 314 operable to rotate a drill bit 316 operatively coupled with the drill motor 314. The drill motor 314 may be a positive displacement hydraulic motor operable to receive and utilize hydraulic power of the drilling fluid to drive the drill bit 316. The piping 312 may extend between the BHA 310 and a piping container 318 located on the seabed 304. In an example implementation of the drilling system 300, the drill piping 312 may be coiled tubing 312 and the piping container 318 may be a reel 318 operable to contain thereon a wound length of the coiled tubing 312. The reel 318 may be rotatably supported on the seabed 304 by a stationary base 320, such that the reel 318 may be rotated to wind and unwind the coiled tubing 312.

The drilling system 300 may further comprise a support structure 322, such as may include or otherwise support a coiled tubing injector 324 and/or other apparatus operable to facilitate movement of the coiled tubing 312. A diverter 326 and a blow-out preventer (BOP) 328 may also be included as part of the drilling system 300. For example, during deployment, the coiled tubing 312 may be passed from the injector 324, through the diverter 326 and the BOP 328, and into the wellbore 306. The coiled tubing injector 324 may be operable to apply an adjustable downward force to the coiled tubing 312 to advance the BHA 310 into the formation 308 to form the wellbore 306. The coiled tubing injector 324 may also apply an upward force to the coiled tubing 312 to retract the BHA 310 from the wellbore 306 toward the seabed 304. Although the example drilling system 300 is shown utilizing the coiled tubing 312 in conjunction with the coiled tubing injector 324, it is to be understood that the drilling system 300 may comprise other support structures and/or conveyance means, such as a derrick, a crane, a mast, a tripod, and/or other structures operable to facilitate makeup and downhole conveyance of other types of drill piping, such as drill pipe joints.

During drilling operations, drilling mud or fluid may be conveyed in a downhole direction through the coiled tubing 312 toward the BHA 310. The drilling fluid may exit the BHA 310 into the wellbore 306 via one or more ports (not shown) in the drill bit 316 and/or other portions of the BHA 310 and then circulated uphole through an annular space defined between a sidewall 307 of the wellbore 306 and the coiled tubing 312. In this manner, the drilling fluid cools and lubricates the drill bit 316 and carries formation cuttings away from the drill bit 316 in the uphole direction and out of the wellbore 306. The diverter 326 may direct the returning fluid to a drilling fluid dump tank 330 or the diverter 326 may direct the returning drilling fluid through a fluid treatment system 334. The treatment system 332 may be operable to filter, clean, and/or separate the drilling fluid from contaminants, such as drill cuttings, carried by the drilling fluid and/or recondition the drilling fluid. The dump tank 330 and the treatment system 334 may prevent the drilling fluid from escaping into the subsea environment.

The cleaned and/or reconditioned drilling fluid may then be conveyed to a tank 336 and stored for later use or transport by a sea vessel. The tank 336 may also function as a drilling fluid buffer from which the drilling fluid may be pumped into the wellbore 306 via the coiled tubing 312 to aid in the drilling operations, as described above. The drilling fluid may be conveyed into and out of the tank 336 at a relatively low pressures by fluid pumps 338, 339, respectively. The pumps 338, 339 may be or comprise centrifugal pumps, positive displacement pumps, such as reciprocating pumps, gear pumps, screw pumps, progressive cavity pumps, or another pumps operable to transfer the drilling fluid.

The drilling system 300 may further comprise a pressure exchanger 340 operable to pump or recirculate the drilling fluid into or through the coiled tubing 312 and the wellbore 306. The pressure exchanger 340 may be fluidly connected with the tank 336 and the coiled tubing 312, such as may permit the pressure exchanger 340 to receive the drilling fluid from the tank 336 and discharge the drilling fluid into the coiled tubing 312. The pressure exchanger 340 may be fluidly connected with the tank 336 via the pump 339 and with the coiled tubing 312 via a fluid conduit 342 and a swivel or other rotating coupling 344 fluidly connected with an end of the coiled tubing 312 wound on the reel 318. The rotating coupling 344 may provide an interface between the conduit 342, which may remain substantially stationary with respect to the seabed 304, and the coiled tubing 312, which may be rotating or otherwise moving with respect to the seabed 304 as the coiled tubing 312 is wound onto and unwound from the reel 318. The pressure exchanger 340 may also be fluidly connected with a seawater pump 346, which may be operable to pump the seawater into and/or through the pressure exchanger 340 to pressurize the drilling fluid within the pressure exchanger 340. The pump 346 may be a positive displacement pump, such as a rotary positive displacement pump or a reciprocating positive displacement pump, such as may be operable to pump seawater at high pressures with respect to an ambient seawater pressure. For example, the pump 346 may be operable to pressurize the seawater up to about 15,000 pounds per square inch (PSI) or more above the ambient seawater pressure. The pressure exchanger 340 may also be fluidly connected with the subsea environment via an outlet port or conduit 348, such as may permit the pressure exchanger 340 to discharge the seawater into the subsea environment. The pressure exchanger 340 may be substantially similar to and/or comprise one or more similar features or modes of operation of the pressure exchanger 200 described above.

Accordingly, during drilling operations, the pressure exchanger 340 may be operable to receive the drilling fluid from the tank 336 at a relatively low pressure and receive the seawater from the pump 346 at a relatively high pressure to pressurize the drilling fluid to a pressure that is substantially greater than the pressure at which the drilling fluid was received. As described above, the drilling fluid received by the pressure exchanger 340 may be pushed or discharged out of the pressure exchanger 340 into the coiled tubing 312 via the fluid conduit 342 and the swivel 344. After the seawater pressure is transferred to the drilling fluid, the seawater may be pushed or discharged from the pressure exchanger 340 into the subsea environment via the outlet port or conduit 348. As the pressure exchanger 340 is fluidly connected with the coiled tubing 312 and with the annular space of the wellbore 306 via the diverter 326, the treatment system 334, the pump 338, the tank 336, and the pump 339, the pressure exchanger 340 may be operable to continuously recirculate the drilling fluid into and out of the wellbore 306.

Figure 11:
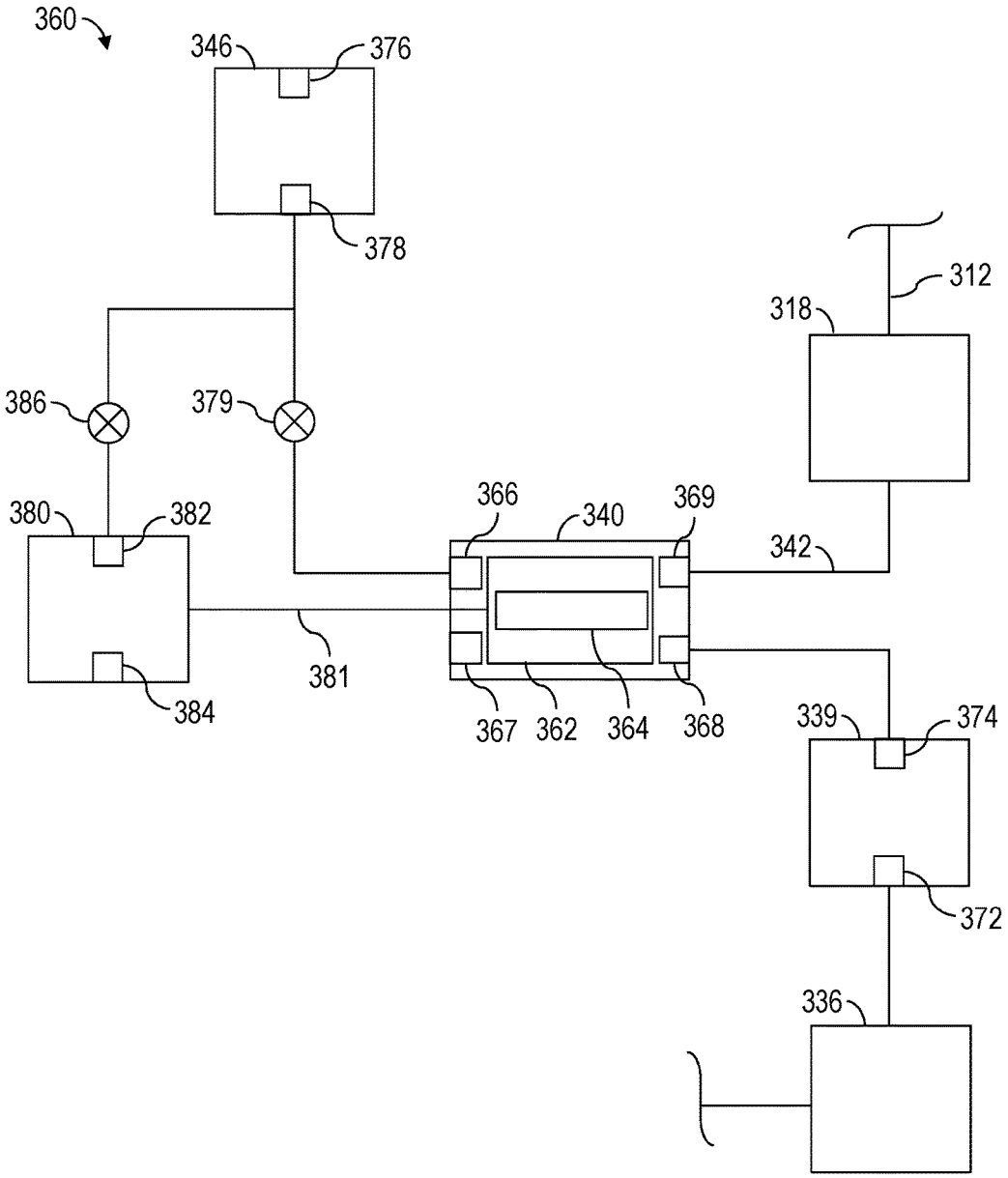
FIG. 11 is a schematic view of at least a portion of an example implementation of apparatus according to one or more aspects of the present disclosure.

FIG. 11 is a schematic view of a portion of the subsea drilling system 300 shown in FIG. 10 and referred to hereinafter as a fluid system 360. The fluid system 360 comprises one or more similar features of the drilling system 300 shown in FIG. 10, including where indicated by like reference numbers, except as described below. The following description refers to FIGS. 10 and 11, collectively.

The fluid system 360 may be utilized to substantially continuously pump or circulate the drilling fluid into and out of the wellbore 306 via the coiled tubing 312 and the annular space of the wellbore 306. The fluid system 360 may comprise the pressure exchanger 340 comprising at least one chamber 362 extending though a rotor 364 rotatably disposed within the pressure exchanger 340. The pressure exchanger 340 may comprise a seawater inlet 366 fluidly connected with the pump 346, a seawater outlet 367 fluidly connected with or exposed to the subsea environment, a drilling fluid inlet 368 fluidly connected with the tank 336 via the pump 339, and the drilling fluid outlet 369 fluidly connected with the coiled tubing 312 wound on the reel 318 via the fluid conduit 342. The pressure exchanger 340, including the chamber 362, the rotor 364, and the ports 366-369, may be substantially similar to and/or comprise one or more similar features or modes of operation of the pressure exchanger 200 described above.

The pump 339 may be included as part of the fluid system 360 to transfer the drilling fluid from the tank 336 into the pressure exchanger 340 at a relatively low pressure. The pump 339 may comprise a fluid inlet 372 fluidly connected with the tank 336 and a fluid outlet 374 fluidly connected with the drilling fluid inlet 368 of the pressure exchanger 340. The fluid system 360 may also comprise the seawater pump 346 having a seawater inlet 376 fluidly connected with or exposed to the subsea environment, such as may be operable to receive the seawater from the subsea environment, and a seawater outlet 378 fluidly connected with the seawater inlet 366 of the pressure exchanger 340. The pumps 338, 339, 346 may be rotated or otherwise actuated by motors (not shown), such as hydraulic motors powered by pressurized hydraulic fluid or by electric motors powered by electric current.

During drilling operations the rotor 362 may rotate the chamber 364 to alternatingly: 1) fluidly connect the drilling fluid inlet 368 with the seawater outlet 367 to permit the drilling fluid to be received into the chamber 364 and to discharge the seawater; and 2) fluidly connect the seawater inlet 366 with the drilling fluid outlet 369 to permit the seawater to be received into the chamber 364 and to discharge the drilling fluid. As described above, the rotor 362 may be caused to rotate by the force of the seawater being received into the chamber 364. Accordingly, the fluid system 360 may further comprise a fluid valve 379 fluidly connected between the pump 346 and the pressure exchanger 340. The fluid valve 379 may be operable to control flow rate of the seawater introduced into the pressure exchanger 340 to control rotational rate of the rotor 362 and/or the flow rate of the drilling fluid pumped by the pressure exchanger 340.

However, the rotor 362 may be rotated by a motor 380 operatively coupled with the rotor 362 via an intermediate driving member 381, such as a shaft or a transmission. The motor 380 may be a hydraulic motor powered by pressurized hydraulic fluid or an electric motors powered by electric current. The motor 380 may also be a hydraulic motor powered by seawater. For example, the motor 380 may comprise a seawater inlet 382 fluidly coupled with a source of pressurized seawater and seawater outlet 384 fluidly connected with or exposed to the subsea environment, such as may permit the seawater to be discharged into the subsea environment. The source of the pressurized seawater may be the pump 346 or another source of pressurized seawater. A fluid valve 386 may be fluidly connected between the motor 380 and the pump 346, such as may be operable to control flow rate of the seawater introduced into the motor 380 to control the rotational speed of the rotor 362.

The fluid valves 379, 386 may be or comprise flow rate control valves, such as needle valves, metering valves, butterfly valves, globe valves, or other valves operable to progressively or gradually open and close to control the flow rate of seawater. Each fluid valve 379, 386 may be actuated remotely by a corresponding actuator (not shown) operatively coupled with each fluid valve 379, 386. The actuators may be or comprise electric actuators, such as solenoids or motors, or fluid actuators, such as pneumatic or hydraulic cylinders or rotary actuators. The fluid valves 379, 386 may also be actuated manually, such as by a lever (not shown).

During drilling operations, as the rotor 362 rotates, the chamber 364 fluidly connects the drilling fluid inlet port 368 and the seawater outlet port 367 to permit the pump 339 to pump the drilling fluid from the tank 336 at a relatively low pressure into the chamber 364 of the pressure exchanger 340 and simultaneously discharge or push the seawater from the chamber 364 into the subsea environment. As the rotor 362 rotates further, the chamber 364 fluidly connects the seawater inlet port 366 and the drilling fluid outlet port 369 to permit the pump 364 to pump the seawater from the subsea environment at a relatively high pressure into the chamber 364 and simultaneously discharge or push the drilling fluid from the chamber 364 at a substantially increased pressure into the coiled tubing 312 via the conduit 342. The pressurized drilling fluid may be conveyed through the coiled tubing and the BHA 310 to actuate the drill bit 316 and to remove the drill cuttings away from the drill bit 316, as described above.

Although FIGS. 10 and 11 show a single pressure exchanger 340 operable to pump the drilling fluid through the coiled tubing 312, it is to be understood that the drilling system 300 within the scope of the present disclosure may comprise a plurality of pressure exchangers 340 fluidly connected with the pump 346, the tank 336, and the coiled tubing 312 via one or more fluid manifolds and/or a plurality of fluid conduits.

In view of the entirety of the present disclosure, including the claims and the figures, a person having ordinary skill in the art will readily recognize that the present disclosure introduces an apparatus comprising a drilling system located on a seabed and operable to drill a wellbore through a rock formation below the seabed, wherein the drilling system comprises: a drill operable to drill the wellbore; piping operable to convey the drill and communicate drilling fluid to the drill during drilling operations; a pump operable to pump seawater; and a pressure exchanger fluidly connected with the pump and the piping, wherein the pressure exchanger is operable to: (a) receive the drilling fluid at a first pressure; (b) receive the seawater from the pump at a second pressure to pressurize the drilling fluid to a third pressure, wherein the second and third pressures are substantially greater than the first pressure; (c) discharge the drilling fluid into the piping; and (d) discharge the seawater into a subsea environment.

The piping may be or comprise coiled tubing, and the drill may be connected at an end of the coiled tubing.

The drilling system may comprise a hydraulic motor operatively coupled between the piping and the drill, and the hydraulic motor may be operable to receive the drilling fluid to rotate the drill during drilling operations.

The pressure exchanger may be fluidly connected with the wellbore, and the pressure exchanger may be operable to receive the drilling fluid from the wellbore.

The pressure exchanger may be fluidly connected with an annular space of the wellbore, the annular space may extend between a sidewall of the wellbore and the piping, and the pressure exchanger may be operable to receive the drilling fluid from the annular space.

The pump may be a first pump, the drilling system may comprise a second pump fluidly connected between the wellbore and the pressure exchanger, and the second pump may be operable to pump the drilling fluid from the wellbore to the pressure exchanger.

The drilling system may comprise a separator fluidly connected between the wellbore and the pressure exchanger, and the separator may be operable to remove drill cuttings from the drilling fluid being received by the pressure exchanger.

An outlet of the pump may be fluidly connected with the pressure exchanger, an inlet of the pump may be fluidly connected with the subsea environment, and the pump may be operable to receive the seawater from the subsea environment via the inlet and discharge the seawater at the second pressure into the pressure exchanger via the outlet.

The pressure exchanger may comprise: a housing having a bore extending between first and second ends of the housing; a rotor rotatably disposed within the bore and comprising at least one chamber extending through the rotor between the first and second ends of the housing; a first cap covering the bore at the first end of the housing, wherein the first cap comprises a drilling fluid inlet and a drilling fluid outlet; and a second cap covering the bore at the second end of the housing, wherein the second cap comprises a seawater inlet and a seawater outlet. The seawater inlet may be fluidly connected with the pump, the seawater outlet may be fluidly connected with the subsea environment, the drilling fluid inlet may be fluidly connected with the wellbore, and the drilling fluid outlet may be fluidly connected with the piping. In such implementations, among others within the scope of the present disclosure, the pressure exchanger may be operable to: receive the drilling fluid into the chamber via the drilling fluid inlet; receive the seawater into the chamber via the seawater inlet; discharge the drilling fluid from the chamber via the drilling fluid outlet; and discharge the seawater from the chamber via the seawater outlet. The drilling system may also comprise a motor operatively coupled with the rotor of the pressure exchanger and operable to rotate the rotor. The motor may be or comprise a hydraulic motor.

The present disclosure also introduces a method comprising: receiving drilling fluid from a drilling fluid source at a first pressure by a pressure exchanger located within a subsea environment; receiving seawater from the subsea environment at a second pressure by the pressure exchanger to increase pressure of the drilling fluid within the pressure exchanger to a third pressure, wherein the second and third pressures are substantially greater than the first pressure; discharging the drilling fluid from the pressure exchanger into piping to communicate the drilling fluid to a drill forming a wellbore in a seabed; and discharging the seawater from the pressure exchanger into the subsea environment.

The piping may be or comprise coiled tubing, and the drill may be connected at an end of the coiled tubing.

The method may be or comprise a method for performing subsea drilling operations.

Discharging the drilling fluid into the piping may cause rotation of the drill to form the wellbore.

A hydraulic motor may be connected between the piping and the drill, and discharging the drilling fluid into the piping may actuate the hydraulic motor to rotate the drill to form the wellbore.

The drilling fluid source may be or comprise an annular space of the wellbore extending between a sidewall of the wellbore and the piping.

The method may comprise: receiving the drilling fluid from the subsea drilling fluid source by a pump; and discharging the drilling fluid from the pump into the pressure exchanger at the first pressure.

The method may comprise removing drill cuttings from the drilling fluid before the drilling fluid is received by the pressure exchanger.

The method may comprise: receiving the seawater from the subsea environment by a pump; and discharging the seawater from the pump into the pressure exchanger at the second pressure.

The pressure exchanger may comprise: a housing having a bore extending between first and second ends of the housing; a rotor rotatably disposed within the bore and comprising at least one chamber extending through the rotor between the first and second ends of the housing; a first cap covering the bore at the first end of the housing, wherein the first cap comprises a drilling fluid inlet and a drilling fluid outlet; and a second cap covering the bore at the second end of the housing, wherein the second cap comprises a seawater inlet and a seawater outlet. The seawater inlet may be fluidly connected with the pump, the seawater outlet may be fluidly connected with the subsea environment, the drilling fluid inlet may be fluidly connected with the subsea drilling fluid source, and the drilling fluid outlet may be fluidly connected with the piping. Receiving the drilling fluid may comprise receiving the drilling fluid into the chamber via the drilling fluid inlet, receiving the seawater may comprise receiving the seawater into the chamber via the seawater inlet, discharging the drilling fluid may comprise discharging the drilling fluid from the chamber via the drilling fluid outlet, and discharging the seawater may comprise discharging the seawater from the chamber via the seawater outlet. The method may further comprise operating a motor to rotate the rotor of the pressure exchanger. Operating the motor may comprise pumping seawater through the motor to actuate the motor.

The present disclosure also introduces a method comprising: pumping drilling fluid from a wellbore at a first pressure into a pressure exchanger located within a subsea environment; pumping seawater from the subsea environment at a second pressure into the pressure exchanger to discharge the drilling fluid out of the pressure exchanger at a third pressure, wherein the second and third pressures are substantially greater than the first pressure; discharging the seawater out of the pressure exchanger into the subsea environment; communicating the drilling fluid discharged from the pressure exchanger through piping to a drill connected with the piping; and rotating the drill to form the wellbore in a seabed.

The piping may be or comprise coiled tubing, and the drill may be connected at an end of the coiled tubing.

Communicating the drilling fluid through the piping may cause rotation of the drill.

A mud motor may be operatively connected between an end of the piping and the drill, and communicating the drilling fluid through the piping may cause the mud motor to rotate the drill.

Pumping the drilling fluid from the wellbore may comprise pumping the drilling fluid from an annular space of the wellbore extending between a sidewall of the wellbore and the piping.

The method may further comprise removing drill cuttings from the drilling fluid before the drilling fluid is received by the pressure exchanger.

The pressure exchanger may comprise a rotor having at least one chamber extending through the rotor, pumping drilling fluid into the pressure exchanger may comprise pumping the drilling fluid into the at least one chamber via a drilling fluid inlet of the pressure exchanger, pumping seawater into the pressure exchanger may comprise pumping the seawater into the at least one chamber via a seawater inlet of the pressure exchanger to increase the pressure of the drilling fluid within the at least one chamber, discharging the drilling fluid out of pressure exchanger may comprise discharging the drilling fluid from the at least one chamber via a drilling fluid outlet of the pressure exchanger, and discharging the seawater out of the pressure exchanger may comprise discharging the seawater from the at least one chamber via a seawater outlet of the pressure exchanger.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a drilling system located on a seabed and operable to drill a wellbore through a rock formation below the seabed, wherein the drilling system comprises:

a drill operable to drill the wellbore;

piping operable to convey the drill and communicate drilling fluid to the drill during drilling operations;

a pump operable to pump seawater; and a pressure exchanger fluidly connected with the pump and the piping, wherein the pressure exchanger is operable to:

receive the drilling fluid at a first pressure;

receive the seawater from the pump at a second pressure to pressurize the drilling fluid to a third pressure, wherein the second and third pressures are substantially greater than the first pressure;

discharge the drilling fluid into the piping; and discharge the seawater into a subsea environment; and wherein the pressure exchanger comprises:

a housing having a bore extending between first and second ends of the housing;

a rotor rotatably disposed within the bore and comprising at least one chamber extending through the rotor between the first and second ends of the housing;

a first cap covering the bore at the first end of the housing, wherein the first cap comprises a drilling fluid inlet and a drilling fluid outlet; and a second cap covering the bore at the second end of the housing, wherein the second cap comprises a seawater inlet and a seawater outlet.

2. The apparatus of claim 1 wherein the piping is or comprises coiled tubing, and wherein the drill is connected at an end of the coiled tubing.

3. The apparatus of claim 1 wherein the drilling system further comprises a hydraulic motor operatively coupled between the piping and the drill, and wherein the hydraulic motor is operable to receive the drilling fluid to rotate the drill during drilling operations.

4. The apparatus of claim 1 wherein the pressure exchanger is fluidly connected with the wellbore, and wherein the pressure exchanger is operable to receive the drilling fluid from the wellbore.

5. The apparatus of claim 1 wherein the pump is a first pump, wherein the drilling system further comprises a second pump fluidly connected between the wellbore and the pressure exchanger, and wherein the second pump is operable to pump the drilling fluid from the wellbore to the pressure exchanger.

6. The apparatus of claim 1 wherein an outlet of the pump is fluidly connected with the pressure exchanger, wherein an inlet of the pump is fluidly connected with the subsea environment, and wherein the pump is operable to receive the seawater from the subsea environment via the inlet and discharge the seawater at the second pressure into the pressure exchanger via the outlet.

7. The apparatus of claim 1 wherein:

the seawater inlet is fluidly connected with the pump;

the seawater outlet is fluidly connected with the subsea environment;

the drilling fluid inlet is fluidly connected with the wellbore; and the drilling fluid outlet is fluidly connected with the piping.

8. A method comprising:

receiving, into a chamber extending through a rotor rotatably disposed within a pressure exchanger that is located within a subsea environment, drilling fluid from a drilling fluid source at a first pressure;

receiving, into the chamber, seawater from the subsea environment at a second pressure to increase pressure of the drilling fluid within the chamber to a third pressure, wherein the second and third pressures are substantially greater than the first pressure;

discharging the drilling fluid from the chamber and into piping to communicate the drilling fluid to a drill connected with the piping forming a wellbore in a seabed; and discharging the seawater from the chamber and into the subsea environment.

9. The method of claim 8 wherein the piping is or comprises coiled tubing, and wherein the drill is connected at an end of the coiled tubing.

10. The method of claim 8 wherein discharging the drilling fluid into the piping causes rotation of the drill to form the wellbore.

11. The method of claim 8 wherein the drilling fluid source is or comprises an annular space of the wellbore extending between a sidewall of the wellbore and the piping.

12. The method of claim 8 further comprising:

receiving the drilling fluid from the drilling fluid source by a pump; and discharging the drilling fluid from the pump into the pressure exchanger at the first pressure.

13. The method of claim 8 further comprising:

receiving the seawater from the subsea environment by a pump; and discharging the seawater from the pump into the pressure exchanger at the second pressure.

14. The method of claim 8 wherein the pressure exchanger comprises a drilling fluid inlet, a drilling fluid outlet, a seawater inlet, a seawater outlet, and a housing in which the rotor is rotatable, such that as the rotor rotates within the housing:

receiving the drilling fluid into the chamber occurs as the chamber aligns with the drilling fluid inlet;

receiving the seawater into the chamber occurs as the chamber aligns with the seawater inlet;

discharging the drilling fluid from the chamber occurs as the chamber aligns with the drilling fluid outlet; and discharging the seawater from the chamber occurs as the chamber aligns with the seawater outlet.

15. The method of claim 8 wherein:

the pressure exchanger comprises:

a housing in which the rotor is rotatable;

a drilling fluid inlet at a first end of the housing;

a drilling fluid outlet at the first end of the housing;

a seawater inlet at a second end of the housing; and a seawater outlet at the second end of the housing; and as the rotor rotates within the housing:

receiving the drilling fluid into the chamber occurs as a first end of the chamber passes across the drilling fluid inlet;

receiving the seawater into the chamber occurs as a second end of the chamber passes across the seawater inlet;

discharging the drilling fluid from the chamber occurs as the first end of the chamber passes across the drilling fluid outlet; and discharging the seawater from the chamber occurs as the second end of the chamber passes across the seawater outlet.

16. A method comprising:

pumping drilling fluid from a wellbore at a first pressure into a pressure exchanger located within a subsea environment, wherein the pressure exchanger comprises a rotor having at least one chamber extending through the rotor, and wherein pumping drilling fluid into the pressure exchanger comprises pumping the drilling fluid into the at least one chamber via a drilling fluid inlet of the pressure exchanger;

pumping seawater from the subsea environment at a second pressure into the pressure exchanger to discharge the drilling fluid out of the pressure exchanger at a third pressure, wherein pumping seawater into the pressure exchanger comprises pumping the seawater into the at least one chamber via a seawater inlet of the pressure exchanger to increase the pressure of the drilling fluid within the at least one chamber, wherein discharging the drilling fluid out of pressure exchanger comprises discharging the drilling fluid from the at least one chamber via a drilling fluid outlet of the pressure exchanger, and wherein the second and third pressures are substantially greater than the first pressure;

discharging the seawater out of the pressure exchanger into the subsea environment, wherein discharging the seawater out of the pressure exchanger comprises discharging the seawater from the at least one chamber via a seawater outlet of the pressure exchanger;

communicating the drilling fluid discharged from the pressure exchanger through piping to a drill connected with the piping; and rotating the drill to form the wellbore in a seabed.

17. The method of claim 16 wherein the piping is or comprises coiled tubing, and wherein the drill is connected at an end of the coiled tubing.

18. The method of claim 16 wherein a mud motor is operatively connected between an end of the piping and the drill, and wherein communicating the drilling fluid through the piping causes the mud motor to rotate the drill.

19. The method of claim 16 wherein pumping the drilling fluid from the wellbore comprises pumping the drilling fluid from an annular space of the wellbore extending between a sidewall of the wellbore and the piping.

20. The method of claim 16 further comprising removing drill cuttings from the drilling fluid before the drilling fluid is received by the pressure exchanger.

* * * * *